United States Patent [19]

McMahon et al.

[11] Patent Number: 4,736,196

[45] Date of Patent: Apr. 5, 1988

[54] ELECTRONIC MONITORING SYSTEM

[75] Inventors: Walter W. McMahon; Christopher J. Zietkiewicz, both of Urbana, Ill.

[73] Assignee: Cost-Effective Monitoring Systems, Co., Urbana, Ill.

[21] Appl. No.: 932,228

[22] Filed: Nov. 18, 1986

[51] Int. Cl.[4] ..... G08B 23/00

[52] U.S. Cl. ..... 340/573; 340/539; 455/100

[58] Field of Search ..... 340/573, 572, 571, 539, 340/551; 455/100

[56] References Cited

U.S. PATENT DOCUMENTS

| | | | |
|---|---|---|---|
| D. 274,796 | 7/1984 | Humble | D10/104 |
| 3,478,344 | 11/1969 | Schwitzgebel et al. | 340/539 X |
| 3,641,540 | 2/1972 | Cutler et al. | 340/539 |
| 3,665,448 | 5/1972 | McGlinchey et al. | 340/539 |
| 3,795,896 | 3/1974 | Isaacs | 340/825.36 |
| 4,063,229 | 12/1977 | Welsh et al. | 340/571 |
| 4,309,697 | 1/1982 | Weaver | 340/572 |
| 4,314,240 | 2/1982 | Schnug | 340/573 |
| 4,318,090 | 3/1982 | Narlow et al. | 340/572 |
| 4,394,645 | 7/1983 | Humble et al. | 340/572 |
| 4,413,254 | 11/1983 | Pinneo et al. | 340/572 |
| 4,418,337 | 11/1983 | Bader | 340/571 |
| 4,430,645 | 2/1984 | Eskandry et al. | 340/572 |
| 4,471,344 | 9/1984 | Williams | 340/572 |
| 4,471,345 | 9/1984 | Barrett, Jr. | 340/572 |
| 4,486,731 | 12/1984 | Westcott | 336/212 |
| 4,489,313 | 12/1984 | Pfister | 340/540 |
| 4,527,567 | 7/1985 | Fischler et al. | 128/419 PT |
| 4,531,117 | 7/1985 | Nourse et al. | 340/572 |
| 4,573,042 | 2/1986 | Boyd et al. | 340/539 |
| 4,593,273 | 6/1986 | Narcisse | 340/539 |
| 4,665,387 | 5/1987 | Cooper et al. | 340/572 |

OTHER PUBLICATIONS

National Institute of Justice Reports—"Monitoring Offenders at Work and at Home Through Electornics", SNI 194, Nov. 1985, pp. 2–6.

National Institute of Justice—"Electronic Monitoring Equipment", A. K. Schmidt, Feb. 28, 1986.

*Primary Examiner*—Joseph A. Orsino
*Assistant Examiner*—Thomas J. Mullen, Jr.
*Attorney, Agent, or Firm*—Allegretti, Newitt, Witcoff & McAndrews, Ltd.

[57] ABSTRACT

A system for monitoring the location of an individual is disclosed and includes a band to be strapped to the individual's wrist or ankle. A trigger, transmitter, and antenna are incorporated into the band. The trigger controls operation of the transmitter and activation is effected by a portable authority-retained control unit. The trigger deactivates the transmitter under predetermined conditions (such as removal of the band) and reactivation requires utilization of the control unit.

6 Claims, 2 Drawing Sheets

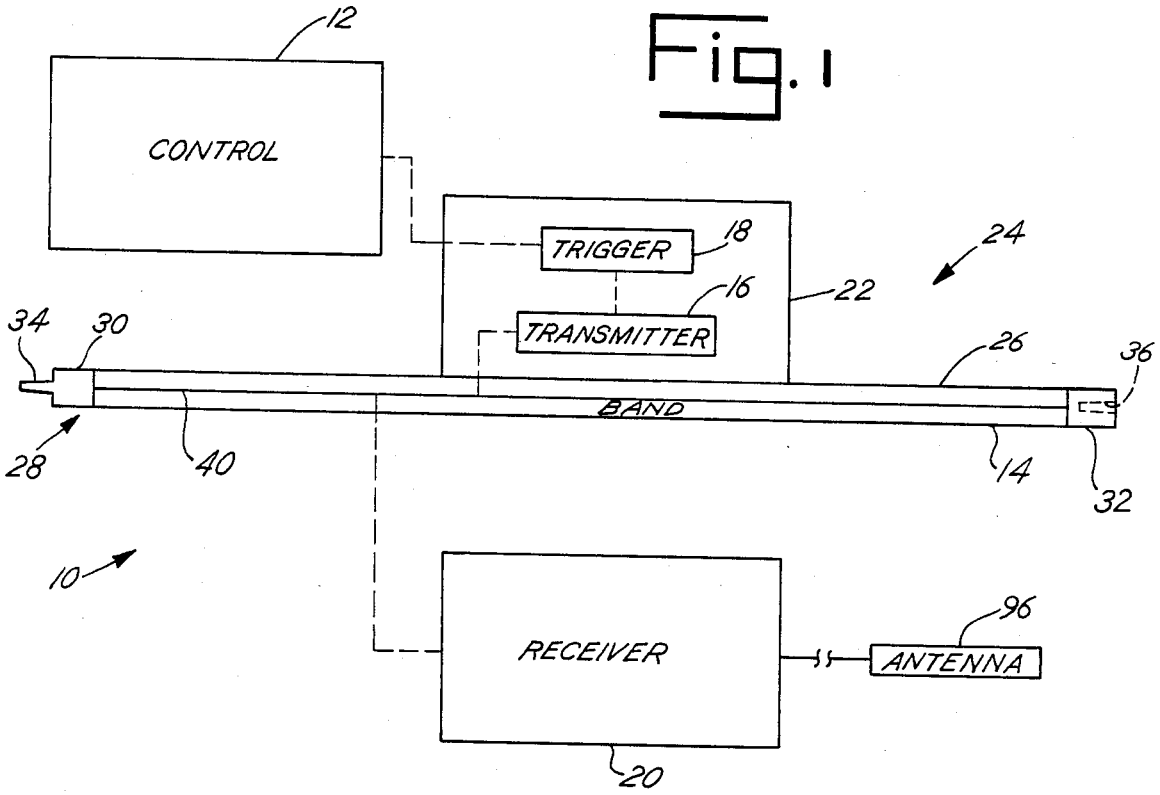
Fig. 1
Fig. 2
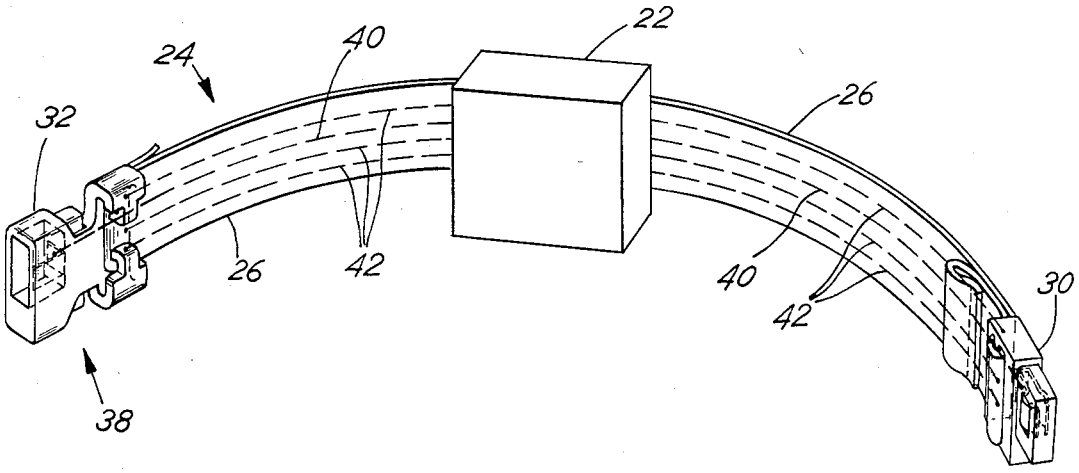

ELECTRONIC MONITORING SYSTEM

BACKGROUND OF THE INVENTION

The present invention relates generally to a system for monitoring the activities and location of an individual and more particularly to a system for readily determining the presence of an individual in a given environment.

The over-crowded condition of many state penal institutions has led to sentencing or probation requiring the convicted individual to remain in a predetermined location under prescribed conditions. For example, the individual may be continuously confined to a house or apartment for a certain length of time. Alternatively, the individual may be so confined during selected hours of day, such as all non-work hours.

The authorities randomly monitor the activities of the individual to ensure compliance. Any non-compliance normally results in immediate incarceration.

This new sentencing/probation procedure has fostered the development of numerous systems to readily determine whether the individual in question is indeed in compliance with the imposed restrictions. One type of monitoring system is characterized as "telephone continuously signaling"; another is "telephone programmed contact"; and a third is "radio signaling".

In the "telephone continuously signaling" type system, a miniaturized transmitter is strapped to the offender and it broadcasts an encoded signal at regular intervals over a predetermined range. A receiver-dialer, located in the offender's home or apartment, detects the signal from the transmitter and "reports" to a central computer whenever signal detection stops and starts. Periodic checks are also made. The central computer accepts data from the receiver-dialer over a telephone line, compares the data with the offender's time/place restrictions or curfew schedule, and alerts correctional officials to any unauthorized absence.

With the "telephone programmed contact" system, a central computer is programmed to call the offender during the house being monitored randomly and/or at specifically selected times. The computer prepares a report on the results of each call. Strapped to the offender's arm is a wristlet, i.e., a plastic module. When the computer calls, the wristlet is inserted into a verifier box, coupled to the telephone line, to establish that the call is being answered by the offender being monitored.

The "radio signaling" system does not require a telephone interconnection. A small transmitter, known as a link, is worn by the offender. A locator unit, placed in the offender's home or other approved location, receives the signal from the link and relays the information by radio signal to the local area monitor. The local area monitor includes a computer or information mangagement system. This equipment is maintained by a network manager, the leader of a small group of individuals who supervise and offer support to the offender. Each local network handles fifteen to twenty-five offenders.

SUMMARY OF THE INVENTION

In a principal aspect, the present invention is a system for verifying the presence of an individual within a certain area. The present invention includes a band adapted to be secured or strapped to the individual, a monitor or transmitter unit, a trigger, a portable control unit, and a portable receiver.

The control unit and receiver are retained by the authorities. The trigger is adapted to receive an activation signal from the control unit and responsively activates the transmitter unit. An antenna wire is embedded in the band and transmits the transmitter signal (as a detection signal) throughout the vicinity of the individual. Strapping of the band to the individual, i.e., closing of a band switch, couples the antenna wire to the transmitter unit. Periodic and/or random checks are made by operation of the receiver in the vicinity of the individuals home or apartment, i.e., the approved location.

The trigger is also responsive to the band switch. Should the band be removed, i.e., should the band switch be opened, the trigger deactivates the transmitter, terminating all detection signal transmission. The transmitter unit cannot be reactivated without the control unit.

Several advantages derive from the present invention. First, there is no need for a telephone interconnection, which substantially expands applicability and reduces costs. Second, the cost of a central computer is avoided.

Third, the system is substantially tamper-proof. Should the band be removed, transmission terminates. Additionally there is no other equipment, such as a receiverdialer, verifier box or locator unit, accessible by the individual for tampering therewith. Fourth, each unit is reusable; the unit need only be cleaned and the power supply need only be periodically changed. Fifth, the unit is small and compact, approximately the size of a large calculator wristwatch.

It is thus an object of the present invention to provide an inexpensive, yet reliable location monitoring system. Another object is a monitoring system which is virtually tamper-proof and reusable. Still another object is a location monitoring system which is portable, i.e., which operates without a telephone line.

These and other features, advantages, and objects of the present invention are set forth or implicit the following description.

BRIEF DESCRIPTION OF THE DRAWING

A preferred embodiment of the present invention is described, in detail, with reference to the drawing wherein:

FIG. 1 is a schematic diagram illustrating the major components of the present invention:

FIG. 2 is a perspective view of the band unit shown in FIG. 1;

DETAILED DESCRIPTION OF A PREFERRED EMBODIMENT

Figure 3:
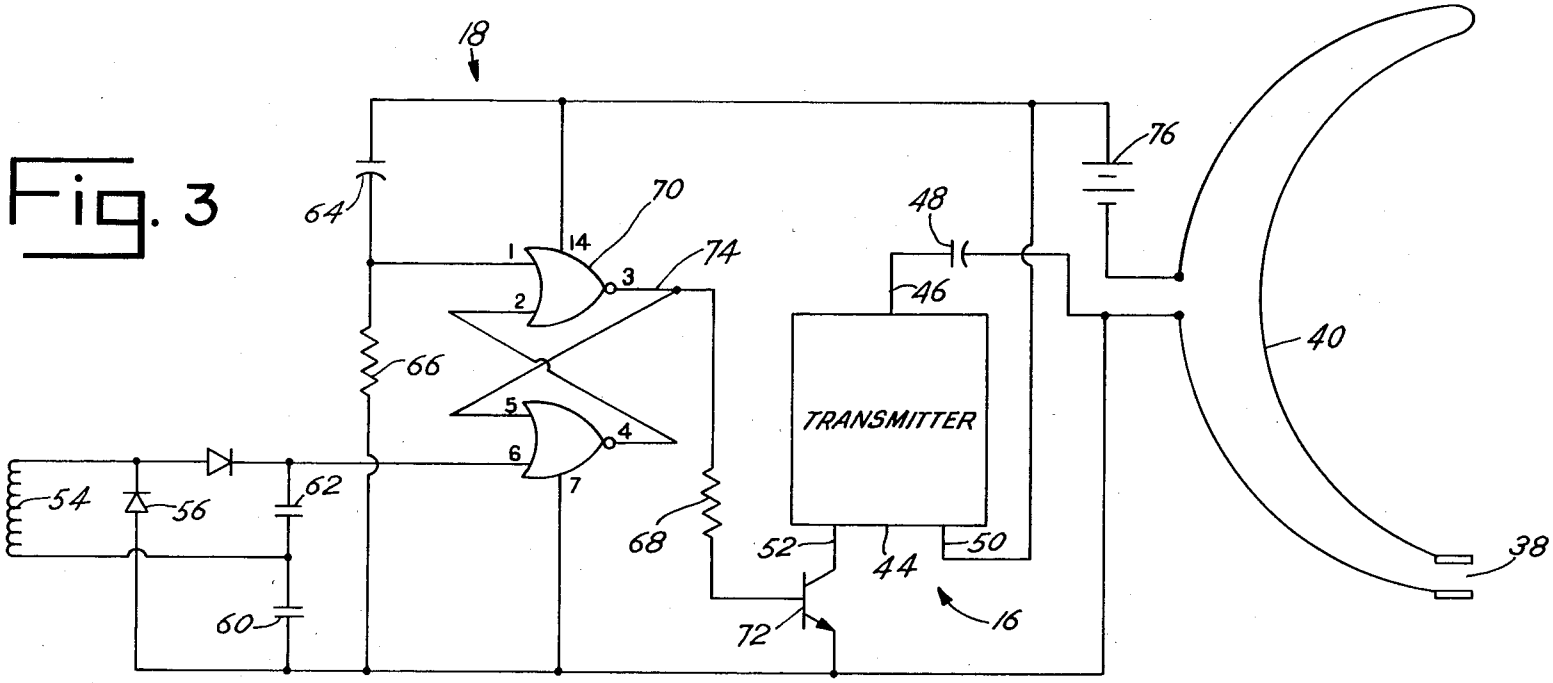
FIG. 3 is an electric schematic diagram of the band unit shown in FIG. 1.
Figure 4:
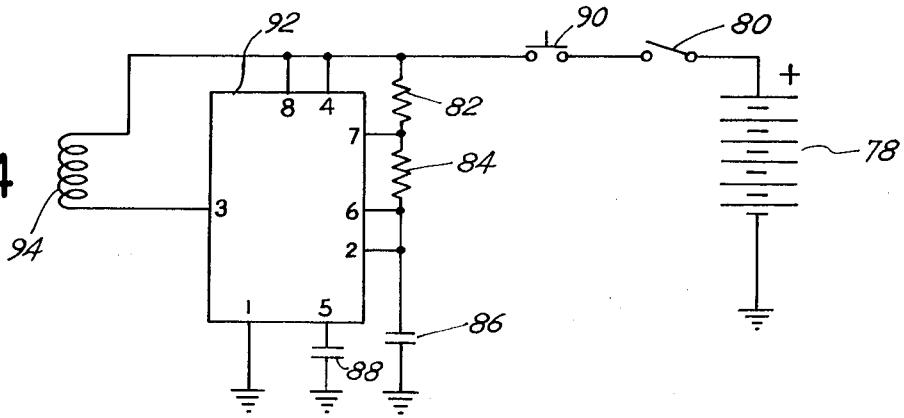
FIG. 4 is an electrical schematic diagram of the exciter shown in FIG. 1.

A preferred embodiment is shown in the drawing as a system 10 for monitoring the location of an individual (not shown). The individual may be a criminal whose activities and/or movement have been restricted by the authorities or a court. Alternatively the individual may suffer from a disease (e.g., Alzheimer's Disease) or mental health problem requiring that the movement and location of the individual be constantly observed. The present invention can be utilized to verify presence within a predetermined area and to track and locate an individual.

The system 10 includes five major components as shown in FIG. 1: portable control means 12; and band 14 adapted to be secured or strapped to the individual; transmitter means 16; trigger means 18; and portable receiver means 20. Preferably the transmitter means 16 and trigger means 18 are incorporated in a wristwatch-like housing 22 affixed to the band 14, thereby defining, in combination, a band unit, generally designated 24.

The band 14 is preferably a nylon or injection-molded plastic strap 26, adjustable in length to accommodate various wrist or ankle sizes. As shown, the band 14 further includes a two-piece fastener, generally designated 28, including a male portion 30 and a female portion 32. The male portion 30 has a conductive, preferably brass tip 34 adapted to contact and mate with a conductive, preferably brass collar 36 within the female portion 32. The tip 34 and collar 36 cooperatively define a band switch, generally designated 38.

A transmission antenna wire 40 passes through the entire length of the strap 26, concealed therein and interconnecting the tip 34 and collar 36. Preferably several nonfunctional "dummy" wires 42 extend through the strap 26, parallel to the antenna wire 40, to substantially reduce the possibility of tampering.

As best shown in FIG. 3, the antenna wire 40 is coupled to the transmitter means 16 whenever the band switch 38 is operable, i.e., closed by attachment of the band 14 to the individual. Whenever the two-piece fastener 28 is opened (so as to remove the band 14), the band switch 38 becomes inoperable or open.

Referring to FIG. 3, the transmitter means 16 includes a conventional, battery-powered transmitter 44, such as Model LF2 (8 gram) marketed by Johnson's Telemetry, Eldorado Springs, Mo. 64744. The transmitter 44 provides a transmitter signal having a predetermined frequency to the antenna wire 40, via an antenna output terminal 46 and capacitor 48. Provision occurs whenever a power terminal 50 of the transmitter 44 is properly biased and whenever a ground terminal 52 thereof is grounded. Upon receipt, the antenna wire 40 transmits the transmitter signal, as a detection signal, throughout the vicinity of the individual.

The trigger means 18 includes an iron core coil 54, diodes 56, 58; capacitors 60, 62, 64; resistor 66, 68; flip-flop 70; and transistor 72, interconnected as shown. The flip-flop 70 is a bi-state multivibrator and the output terminal 74 thereof controls the operational state of the transistor 72. Whenever the transistor 72 is conductive or "on", the ground terminal 52 of the transmitter 44 is grounded. The transistor 72 is conductive whenever a "1" is present at the output terminal 74.

The transmitter means 16 and trigger means 18 are powered by a three-volt lithium battery 76. The battery 76 is replaceable, thereby extending the life of each reusable band unit 24. The battery 76 may also be rechargeable; if so, the housing 22 includes a pair of jackets (not shown), interconnected to the battery 76, for application of a recharging voltage. Preferably the battery 76 is isolated during recharging.

The circuitry of the transmitter means 16 and trigger means 18 is preferably potted within the housing 22. Thus any attempt to open the housing 22 or alter the circuitry will destroy the band unit 24 and terminate transmission.

When the band unit 24 is first strapped to the individual, the band switch 38 is closed and the antenna wire 40 is coupled to the transmitter means 16. The transmitter 44 is not operable, however, because the transistor 72 is nonconductive.

The trigger means 18 is responsive, in part, to the control means 12. The control means 12 is retained and maintained by the authorities and is utilized to initiate transmission of the detection signal.

More particularly, the control means 12 includes a battery 78; on/off switch 80; resistors 82, 84; capacitors 86, 88; exciter switch 90; oscillator 92; and transmitting coil 94, interconnected as shown. The oscillator 92 is a conventional 555 timer. The control means 12 is adapted to be magnetically coupled to the trigger means 18 and to provide an activation signal in the form of a current pulse through the transmitting coil 94.

The control means 12 is placed in physical contact with the housing 22 such that the coils 54, 94 closely align. The current pulse through the transmitting coil 94 thus induces a current on the coil 54 of the trigger means 18.

The induced current, in turn, causes flip-flop 70 to change the signal at the output terminal 74 from a "0" to a "1". The transistor 72 then conducts, shorting the ground terminal 52, and the transmitter 44 delivers the transmission signal to the antenna wire 40. The band unit 24 is now fully operational and the monitoring process may begin.

The trigger means 18 is further coupled and responsive to the band switch 38. Should the band switch 38 be opened, then the flip-flop 70 returns to its original state with a "0" at output terminal 74. Transmission of the detection signal is thus automatically terminated.

As best shown in FIG. 3, opening of the band switch 38 effectively disconnects the battery 76 from the trigger means 18. The battery 76 is preferably coupled to the trigger means 18 via the antenna wire 40 such cutting of the band 14 also terminates transmission, thereby further reducing the possibility of tampering. Removal of the battery 78 has the same effect.

Significantly, the trigger means 16 is a one-way switch-like mechanism. Once the trigger means 18 terminates transmission for whatever reason, there can be no reactivation of the transmission means 16 without the control means 12.

The portable receiver means 20 is any conventional receiver adapted to respond to the detection signal. One such receiver is the Model CE12, marketed by Custom Electronics, Urbana, Ill. 61801. The portable receiver means 20 is preferably adapted to be magnetically mounted to the interior roof of a police vehicle.

As shown schematically in FIG. 2, the receiver means 20 includes a detachable receiver antenna 96. With a conventional antenna, the range of detection for the system 10 is preferably 250 feet. Substituting a directional loop antenna (such as Models L50SM, L164SM, and L216SM marketed by AF Electronics, White Heath, Ill. 61884) permits close tracking of the individual. The receiver means 20 may also include jacks for ear plugs to facilitate tracking and/or jacks for a recording mechanism.

Preferably the receiver means 20 is operable at certain predetermined frequencies corresponding to the frequencies of certain detection signals. Thus, one receiver means 20 may be used to monitor a group of restricted individuals, thereby further reducing the overall cost of the system 10.

A single preferred embodiment has been described. It is to be understood that changes and modifications can be made without departing from the true scope and spirit of the present invention, as defined by the following claims. Those claims are to be interpreted in view of the foregoing.

What is claimed is:

1. A system for monitoring the movement of an individual comprising, in combination:

portable control means for providing an activation signal;

a band adapted to be secured to said individual including a band switch and an antenna wire, said band switch being operable whenever said band is secured to said individual;

transmitter means for selectively providing a transmitter signal to be transmitted by said antenna wire throughout the vicinity of said individual as a detection signal, said band switch coupling said antenna wire to said transmitter means whenever said band switch is operable;

trigger means, responsive to said portable control means and said band switch, for receiving said activation signal and responsively activating said transmitter means and for deactivating said transmitter means whenever said band switch becomes inoperable; and portable receiver means for receiving said detection signal.

2. A system as claimed in claim 1 wherein said band is adjustable in length.

3. A system as claimed in claim 2 wherein said band includes a two-piece fastener incorporating said band switch.

4. A system as claimed in claim 1 or 3 wherein said control means is magnetically coupled to said trigger means during provision of said activation signal.

5. A system as claimed in claim 4 wherein said band further includes at least one nonfunctional wire extending along said antenna wire.

6. A system as claimed in claim 1 wherein said transmitter means and said trigger means are powered by a battery through said antenna wire, said trigger means deactivating said transmitter means whenever said battery is disconnected.

* * * * *